United States Patent [19]

Polyanin et al.

[11] 3,944,089

[45] Mar. 16, 1976

[54] LOADER

[76] Inventors: Valery Andreevich Polyanin, ulitsa Kirova, 41, kv. 66; Anatoly Jurievich Berkovich, ulitsa Dimitrova, 39, kv. 13; Georgy Vasilievich Zabegalov, Lenskaya ulitsa, 9, kv. 12; Jury Konstantinovich Soin, Savinskaya naberezhnaya, 5, kv. 29, all of Moscow, U.S.S.R.

[22] Filed: Sept. 9, 1974

[21] Appl. No.: 504,234

[52] U.S. Cl. ..... 214/131 A; 172/273

[51] Int. Cl.[2] ..... E02F 3/72

[58] Field of Search ..... 214/131 A; 172/273, 275

[56] References Cited

UNITED STATES PATENTS

| | | | |
|---|---|---|---|
| 2,738,083 | 3/1956 | Cadwell | 214/131 A |
| 3,043,375 | 7/1962 | Åström | 214/131 A |
| 3,554,396 | 1/1971 | Demkiw | 214/131 A |
| 3,612,311 | 10/1971 | Eidy et al. | 214/131 A |

FOREIGN PATENTS OR APPLICATIONS

| | | | |
|---|---|---|---|
| 1,252,587 | 10/1967 | Germany | 214/131 A |
| 1,248,551 | 8/1967 | Germany | 214/131 A |

*Primary Examiner*—Robert J. Spar
*Assistant Examiner*—Ross Weaver
*Attorney, Agent, or Firm*—Holman & Stern

[57] ABSTRACT

A loader which can be used most effectively on construction projects for excavation and loading of loose materials, and in agriculture for the mechanization of such jobs as loading of fertilizer, peat and root crops. The loader is provided with a frame for mounting the load-handling equipment on the tractor body. The frame consists of side members, rigidly secured at one end by a cross member while at the other ends they are fastened by ball supports on the rear axle of a tractor on both sides of its body. Each side member consists of two parts interconnected by a locking device allowing their rigid connection and separation, with one of the parts carrying the load-handling equipment and installed with a provision for being removed together with this equipment by moving axially a bar which fastens the cross member on the tractor body. Such an arrangement ensures rapid installation and removal of the load-handling equipment without the use of load-hoisting devices.

5 Claims, 8 Drawing Figures

LOADER

BACKGROUND OF THE INVENTION

The present invention relates to the mechanization of load-handling operations and more specifically to loaders mounted on wheeled tractors.

This invention will prove most effective on construction projects to the excavation and loading of loose materials and in agriculture, for the mechanization of loading such materials as fertilizers, peat and root crops.

PRIOR ART

At present, the majority of loaders are mounted on wheeled tractors. The contemporary wheeled tractors are basically of a half-frame design in which the body of the tractor defined by the rigidly interconnected engine and power transmission units rests on the rear axle. The front axle of the tractor is installed on a half-frame secured to the engine flywheel housing.

In the art, are known loaders wherein the load-handling equipment can be quickly installed on, and removed from, the tractor without the use of load-hoisting devices. Before mounting on the tractor, such equipment is placed separately, supported by its operating element and two special props. Then, the equipment is mounted by driving the tractor thereon. The frame of such a load-handling equipment is secured by various fastening elements at several points on the tractor half-frame. However, fastening the load-handling equipment on the tractor at several points causes considerable twisting and bending stresses acting on the tractor body during the loader operation. These additional stresses may cause failure of the tractor body which has but a limited strength. Such a disadvantage limits the field of loader application and impairs its basic characteristics.

Also known in the art are loaders in which the load-handling equipment is mounted on the tractor body with the aid of a frame which relieves the body of the additional twisting and bending stresses arising during loader operation. In these loaders, the frame consists of two side members connected rigidly at one end by a cross member whereas their other ends are installed rigidly on the rear axle of the tractor at both sides of its body. The cross member is articulated on the tractor body (see, for example, U.S. Pat. No. 3,335,882).

A disadvantage of the above-mentioned design of the loader lies in the impossibility of a rapid installation and removal of the load-handling equipment on the tractor due to the fact that the articulated support of the cross member and the rigid attachment of the ends of the side members do not allow the load-handling equipment to be removed without the use of some load-hoisting devices. Installation of the load-handling equipment in these loaders is also effected with the aid of load-hoisting devices by pushing the frame of the load-handling equipment on the tractor, orienting the frame with respect to the tractor body and inserting the ends of the side members into the space limited by the rear wheels, tractor body and rear wheel fenders. Then, the frame is fastened on the three above-mentioned supports. Here, the most difficult operation is fastening the ends of the side members to the rear axle of the tractor because the point of fastening is located in a "hard-to-get-at place."

OBJECTS AND SUMMARY OF THE INVENTION

An object of the present invention resides in eliminating the aforesaid disadvantages.

The main object of the invention is to provide such a layout of the loader in which, due to an improved frame and its supports, the tractor body is relieved of additional stresses and the load-handling equipment is rapidly installed and removed without the use of load-hoisting devices.

The above and other objects are accomplished by providing a loader wherein, the frame carrying the load-handling equipment is constituted by two side members which are rigidly interconnected at one end by a cross member resting on the tractor body while their other ends are mounted on the rear axle of the tractor on both sides of its body in which, according to the invention, the support of the frame cross member is defined in the form of a cylindrical bar arranged along the fore-and-aft axis of the tractor with a provision for axial movement in a horizontal plane relative to the tractor, each of the two side members being constituted of two parts interconnected by a locking device which makes it possible either to connect or detach these parts with one of these parts (the one connected to the cross member) carrying the load-handling equipment and being removable together with the latter by moving the bar axially.

Owing to the provision of the locking device, such a design of the frame makes it possible to disconnect rapidly the front part of the frame carrying the load-handling equipment from its rear part and to remove the equipment from the tractor because the cylindrical bar of the cross member support provides for the axial movement in a horizontal plane. Removal of the equipment is effected by driving off the tractor, without the use of any load-hoisting devices. During this operation, the load-handling equipment together with the front end of the frame rests on its operating element and two removable props while the rear part of the frame is constantly mounted on the tractor. To mount the equipment, the removal operations must be reversed.

It is most practicable that one end of the cylindrical bar should be secured to the cross member while its other end should be inserted into a hole in the tractor body being capable of moving axially, and should be provided with a tapered extension for orienting the bar relative to the hole during installation of the load-handling equipment.

To ensure rigid fastening of the side members to each other in operation and their rapid disconnection during removal of the load-handling equipment, it is practicable that the locking device should have lugs secured on the parts of the side member and interconnected by a pin set horizontally and perpendicularly to the side members, and a bolt whose threaded portion should be located in a nut articulated to one of the parts of the side member with a provision for swinging in a vertical plane along the side members while its other portion adjoining the head should be located in a slot provided in the other part of the side member and open at the side opposite to the lugs to enable swinging off the bolt during the removal of the load-handling equipment.

To enhance the dependability of the locking device and to carry loads in the horizontal and vertical planes, it is practicable that the locking device should comprise, additionally, a stop located on one of the parts of the side member, with the stop entering the slot located on the other part in order to take up the clearance which may appear between the pin and the lugs.

In addition, according to the invention, each side of the tractor body should have a bracket provided with a hole for receiving the pin of the locking device which, after the removal of the load-handling equipment, would lock the parts of the side members mounted on the rear axle of the tractor with the aid of ball supports.

The ball support allows the rear ends of the side members to move in a horizontal plane for fastening them to the tractor body after removing the load-handling equipment, relieves the rear axle of the tractor of twisting stresses.

The use of the pin of the locking device for securing the rear ends of the frame to the tractor body brings the number of fastening elements to a minimum and prevents a chance fastening of the frame at additional points to the tractor body during installation of the load-handling equipment.

Now the invention will be described in detail by way of example with reference to the accompanying drawings in which:

DETAILED DESCRIPTION OF THE INVENTION

Figure 1:
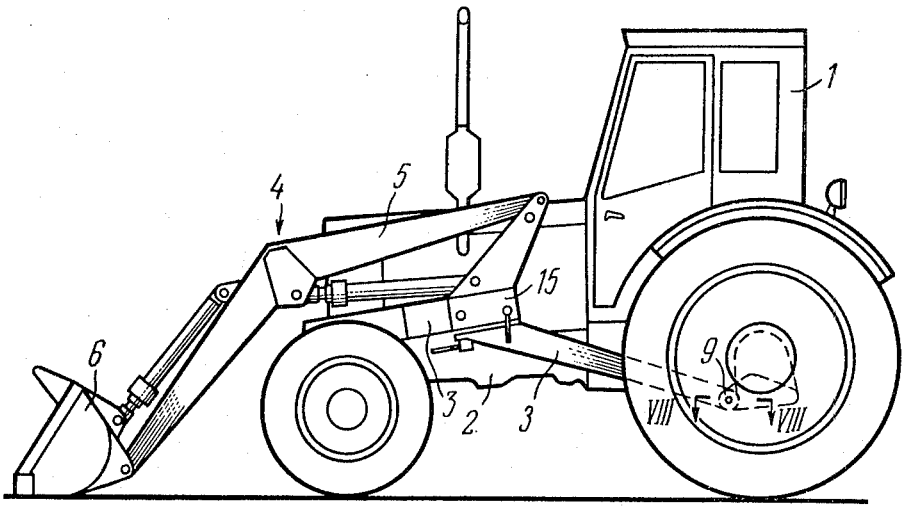
FIG. 1 shows in side elevation the loader according to the invention.

The loader comprises a wheeled tractor 1 (FIG. 1) whose body 2 mounts a load-handling equipment 4 on a frame 3, with such equipment including a boom 5 and an operating element 6.

Figure 2:
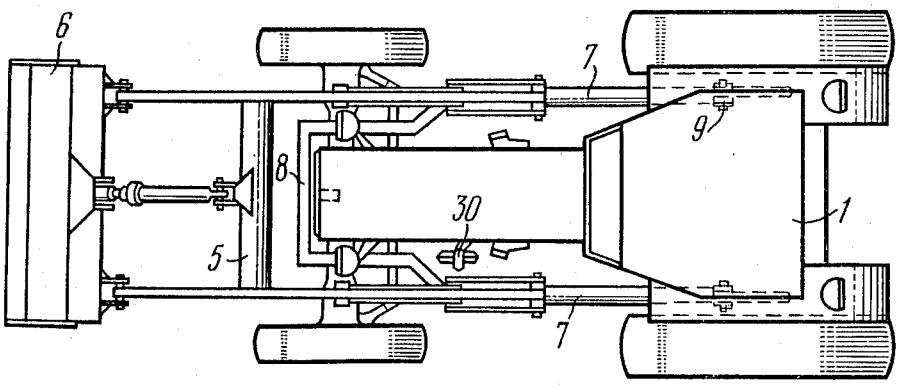
FIG. 2 is a plan view of the loader shown in FIG. 1.

The frame 3 is constituted by two side members 7 (FIG. 2) which are rigidly interconnected at one end by a cross member 8. The other ends of these side members are mounted with the aid of supports 9 on the rear axle of the tractor on both sides of its body 2.

Figure 3:
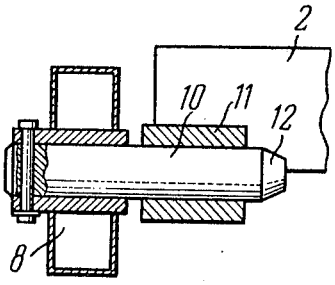
FIG. 3 shows in a longitudinal section the cross member support.

The cross member 8 has a support on the tractor body, with the support being in the form of a cylindrical bar 10 (FIG. 3) arranged along the fore-and-aft axis of the tractor with one end secured to the cross member 8. The other end of this bar 10 is located in a hole 11 of the body 2 to allow the bar to move relative to the tractor during installation of the load-handling equipment. For orienting the bar 10 relative to the hole 11, the bar is provided with a tapered extension or end 12.

Figure 4:
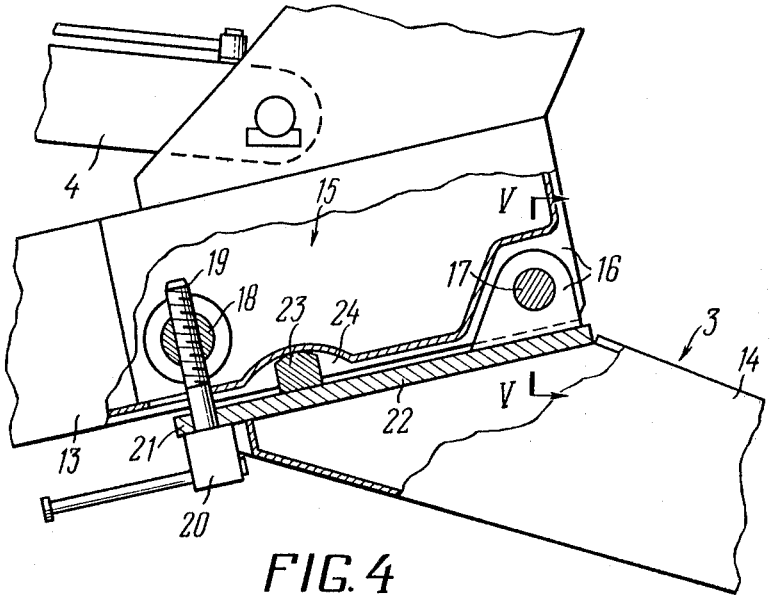
FIG. 4 shows the locking device, partly cut out.

Each side member 7 consists of two parts 13 and 14 (FIG. 4) interconnected by a locking device 15 which allows the parts to be rigidly secured to each other and disconnected at will.

The part 13 of the side member 7 which carries the load-handling equipment 4 can be removed from the tractor together with the equipment when the bar 10 moves relative to the tractor.

The locking device comprises lugs 16 secured on the parts 13 and 14 of the side member 7 and interconnected by a pin 17. The part 13 carries an articulated nut 18 which can swing in a vertical plane along the side member 7, with the hole of this nut receiving the threaded portion of a bolt 19. The cylindrical portion of said bolt adjoining a head 20 is located in a slot 21 of a plate 22 secured to the part 14 of the side member 7. The slot 21 is open at the side opposite to the lugs 16 for swinging off the bolt during the removal of the load-handling equipment 4.

To ensure the rigidity of fastening of the parts 13 and 14 in the course of loader operation, the plate 22 carries a stop 23 entering a slot 24 located on the part 13 of the side member 7. This stop is intended to take up the clearance which may appear between the pin 17 and the lugs 16.

Figure 5:
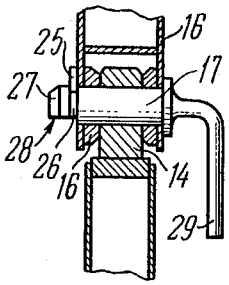
FIG. 5 is a section taken along line V — V in FIG. 4.

The pin 17 is held against axial movement in the lugs 16 by a plate 25 (FIG. 5) entering a circular recess 26 of the pin. One end of the pin 17 has an extension 27 provided with a flat 28 which allows the pin to be taken easily out of the lug by turning the pin through 180° with a handle 29 secured on the other end of the pin 17.

Fastened to each side of the body 2 of the tractor 1 is a bracket 30 (FIG. 6) with a hole 31 (FIG. 7) which receives the pin 17 for fastening the rear parts 14 of the side members 7 to the tractor after the removal of the load-handling equipment 4. This is done by the use of the lug 16 of the locking device 15, with the lug being fastened on the rear part 14 of the side member 7.

Figure 8:
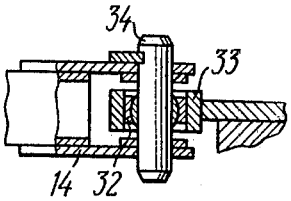
FIG. 8 is a section taken along line VIII — VIII in FIG. 1.
Figure 6:
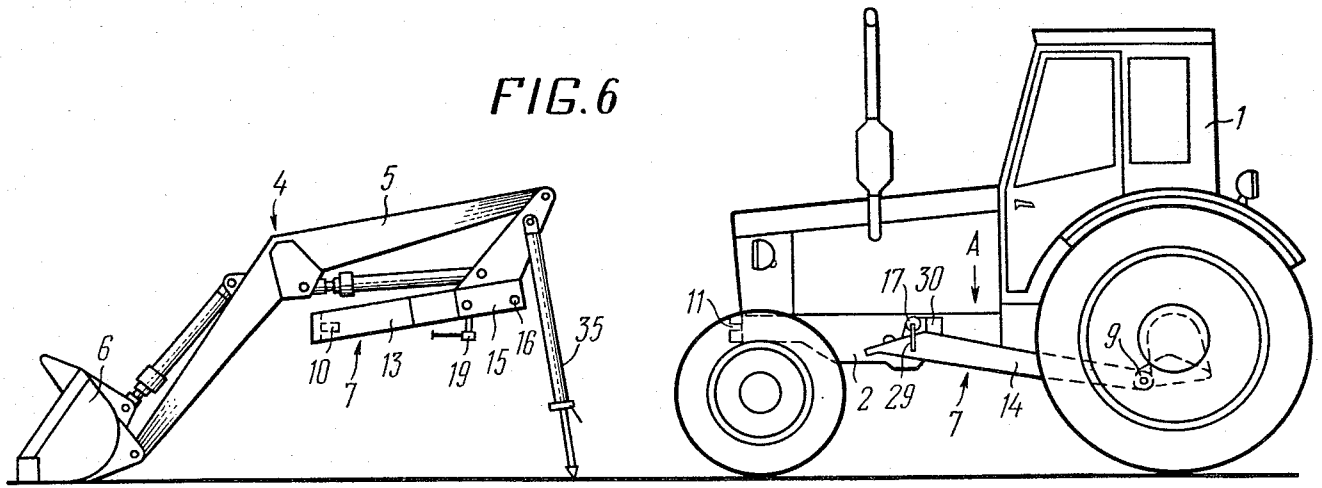
FIG. 6 shows the loader according to the invention with the load-handling equipment removed.
Figure 7:
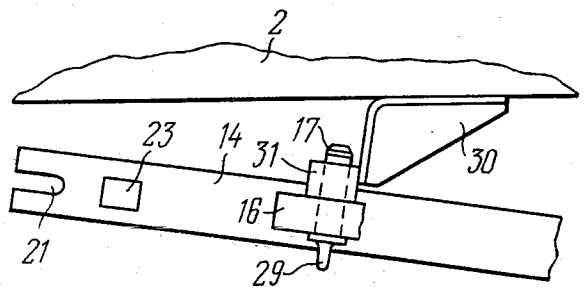
FIG. 7 is a view along arrow A in FIG. 6.

Each support 9 of the parts 14 of the side members 7 is in the form of a ball support 32 (FIG. 8) installed in a bracket 33 fastened to the rear axle on both sides of the tractor body 2. The parts 14 are connected with the ball supports 32 by pins 34. Upon being removed from the tractor, the load-handling equipment rests on its operating element 6 and two removable props 35 (FIG. 6).

The load-handling equipment is installed and removed as follows:

The tractor is driven to the load-handling equipment placed on level ground on the props 35 and the operating element 6 (FIG. 6), with the tractor carrying the parts 14 of the side member 7, which are constantly mounted on the tractor. The shape and method of fastening of these parts of the side members do not interfere with the employment of the tractor as a prime mover on agricultural jobs, for towing trailers, etc.

For installing the load-handling equipment 4, the tractor 1 moves in between the parts 13 of the side members 7 so as to insert the cylindrical bar 10 into the hole 11 in the body 2 of the tractor 1.

Then, the only thing to do is to interconnect the parts 13 and 14 of the side members 7 with the aid of the locking device 15. For this purpose, it is necessary to take out, one after the other, the pins 17 securing the rear parts 14 of the side members 7 to the tractor body. The front end of the rear part 14 is brought to the joint of the locking device 15. The pin 17 is inserted into the lugs 16 of the locking device 15. The bolt 19 is turned and inserted into the slot 21 after which the joint is tightened. In the meantime, the stop 23 takes up the clearances between the lugs 16 and the pin 17 and ensures the requisite stiffness of the connection between the parts of the side members.

On completion of installation, the props 35 are removed.

Removal of the load-handling equipment is effected by reversing the installation procedure.

What is claimed is:

1. A loader comprising a wheeled tractor provided with a body and front and rear axles; said body having a fore- and aft-axis; a load-handling equipment having a frame and being mounted on the body of said tractor by means of said frame; said frame including side members and a cross member; said side members consisting, each, of two parts; one pair of said side members being interconnected by said cross member and carrying said load-handling equipment, said cross member having a single support on said tractor body; said support of said cross member being defined by a cylindrical bar located along the fore- and-aft axis of the tractor body and secured with a provision for axial movement in a horizontal plane relative to the tractor body to allow the removal from the tractor of the parts of said side members carrying the load-handling equipment; another pair of said parts of the side members being hingedly mounted on said rear axle of the tractor on both sides of said tractor body; and a locking device for a rigid fastening and separation of said parts of the side members.

2. The loader according to claim 1 in which one end of said cylindrical bar is fastened to the cross member and the other end is located in a hole in the tractor body to provide for axial movement of said bar.

3. A loader comprising a wheeled tractor provided with a body and front and rear axles; a load-handling equipment having a frame and being mounted on the body of said tractor by means of said frame; said frame including side members and a cross member; said side members consisting, each, of two parts; one pair of said side members being interconnected by said cross member and carrying said load-handling equipment; said cross member having a support on said tractor body; said support of said cross member being defined by a cylindrical bar arranged along the fore-and-aft axis of the tractor and secured with a provision for axial movement relative to the tractor to allow the removal from the tractor of the parts of said side members carrying the load-handling equipment; another pair of said parts of the side members being mounted on said rear axle of the tractor on both sides of said tractor body; and a locking device for a rigid fastening and separation of said parts of the side members, said locking device comprising lugs secured on the parts of each side member and interconnected by a pin arranged horizontally and perpendicularly to said parts, and a bolt having a threaded portion located in a nut articulated on one of the parts of the side member with a provision for swinging in a vertical plane along the parts while a cylindrical portion of said bolt adjoining its head is located in a slot provided in the other part of the side member and open at the side opposite to said lugs to enable the bolt to be swung off during the removal of the load-handling equipment.

4. The loader according to claim 3 in which said locking device further comprises a stop located on one of the parts of each side member, with said stop entering a slot located on the other part in order to take up a clearance which may appear between the pin and the lugs.

5. The loader according to claim 1 including a bracket secured on each side of the tractor body, said bracket having a hole to receive a pin of the locking device which fastens the parts of the side members after the removal of the load-handling equipment, with said parts being mounted on the rear axle of the tractor with the aid of ball supports.

* * * * *